US012137744B2

(12) United States Patent
Lee et al.

(10) Patent No.: US 12,137,744 B2
(45) Date of Patent: Nov. 12, 2024

(54) AEROSOL GENERATING DEVICE

(71) Applicant: KT&G CORPORATION, Daejeon (KR)

(72) Inventors: Jong Sub Lee, Gyeonggi-do (KR); Sung Rok Oh, Gyeonggi-do (KR)

(73) Assignee: KT&G CORPORATION, Daejeon (KR)

( * ) Notice: Subject to any disclaimer, the term of this patent is extended or adjusted under 35 U.S.C. 154(b) by 569 days.

(21) Appl. No.: 16/970,830

(22) PCT Filed: Apr. 28, 2020

(86) PCT No.: PCT/KR2020/005570

§ 371 (c)(1),
(2) Date: Aug. 18, 2020

(87) PCT Pub. No.: WO2020/222496

PCT Pub. Date: Nov. 5, 2020

(65) Prior Publication Data

US 2022/0248768 A1 Aug. 11, 2022

(30) Foreign Application Priority Data

Apr. 30, 2019 (KR) ..... 10-2019-0050995

(51) Int. Cl.
*A24F 40/51* (2020.01)
*A24F 40/10* (2020.01)
*A24F 40/485* (2020.01)

(52) U.S. Cl.
CPC ..... *A24F 40/51* (2020.01); *A24F 40/10* (2020.01); *A24F 40/485* (2020.01)

(58) Field of Classification Search
CPC ..... A24F 40/51; A24F 40/485; A24F 40/10
See application file for complete search history.

(56) References Cited

U.S. PATENT DOCUMENTS 11,298,479 B2 4/2022 Fraser et al.
2004/0089314 A1 5/2004 Felter et al.
(Continued)

FOREIGN PATENT DOCUMENTS

CA 2 257 618 C 7/2006
CN 109195654 A 1/2019
(Continued)

OTHER PUBLICATIONS

Extended European Search Report issued Feb. 7, 2022 in European Application No. 20751468.8.
(Continued)

*Primary Examiner* — Christopher M Rodd
*Assistant Examiner* — Daniel Edward Vakili
(74) *Attorney, Agent, or Firm* — Sughrue Mion, PLLC

(57) ABSTRACT

Provided is an aerosol generating device including a cartridge comprising: an atomizer heating an aerosol generating material to generate aerosol; a mouthpiece through which the generated aerosol is released to outside; a main body accommodating the cartridge; and a sensor configured to detect release of the aerosol to the outside; wherein a first air channel is formed between the cartridge and the main body and guides external air introduced through an air inlet to the mouthpiece through the atomizer, and wherein a second air channel is formed in the main body such that the first air channel and the second air channel are in fluid communication, and wherein the sensor detects the release of the aerosol to the outside based on a change in air flow rate or air pressure of the second air channel.

8 Claims, 9 Drawing Sheets

(56) References Cited

U.S. PATENT DOCUMENTS

| | | | | |
|---|---|---|---|---|
| 2019/0083720 | A1 | 3/2019 | Leadley et al. | |
| 2019/0150520 | A1 | 5/2019 | Fraser et al. | |
| 2019/0200679 | A1* | 7/2019 | Dayioglu | A24F 47/00 |
| 2019/0297950 | A1 | 10/2019 | Wendt Thevenaz et al. | |
| 2022/0265806 | A1* | 8/2022 | Lai et al. | A24F 47/00<br>131/273 |

FOREIGN PATENT DOCUMENTS

| | | | | | |
|---|---|---|---|---|---|
| CN | 109619695 | A | | 4/2019 | |
| JP | 2006-505281 | A | | 2/2006 | |
| KR | 10-2012-0132004 | A | | 12/2012 | |
| KR | 10-1324667 | B1 | * | 11/2013 | A24F 47/00 |
| KR | 10132466781 | | * | 11/2013 | A24F 40/42 |
| KR | 10-2018-0125020 | A | | 11/2018 | |
| KR | 10-2019-0006540 | A | | 1/2019 | |
| WO | 2016/066635 | A1 | | 5/2016 | |
| WO | WO 2017/2165516 | A1 | * | 12/2017 | A24F 47/00 |
| WO | WO-2017216516 | A1 | * | 12/2017 | A24B 15/167 |
| WO | WO-2018055334 | A1 | * | 3/2018 | A24F 40/10 |
| WO | 2018/107018 | A1 | | 6/2018 | |

OTHER PUBLICATIONS

Notice of Reasons for Refusal dated Oct. 5, 2021 from the Japanese Patent Office in Japanese Application No. 2020-546915.

International Search Report dated Sep. 22, 2020 in International Application No. PCT/KR2020/005570.

Office Action issued Oct. 29, 2020 in Korean Application No. 10-2019-0050995.

Communication dated Feb. 11, 2023, issued in Chinese Application No. 202080001661.X.

* cited by examiner

[Fig. 1]
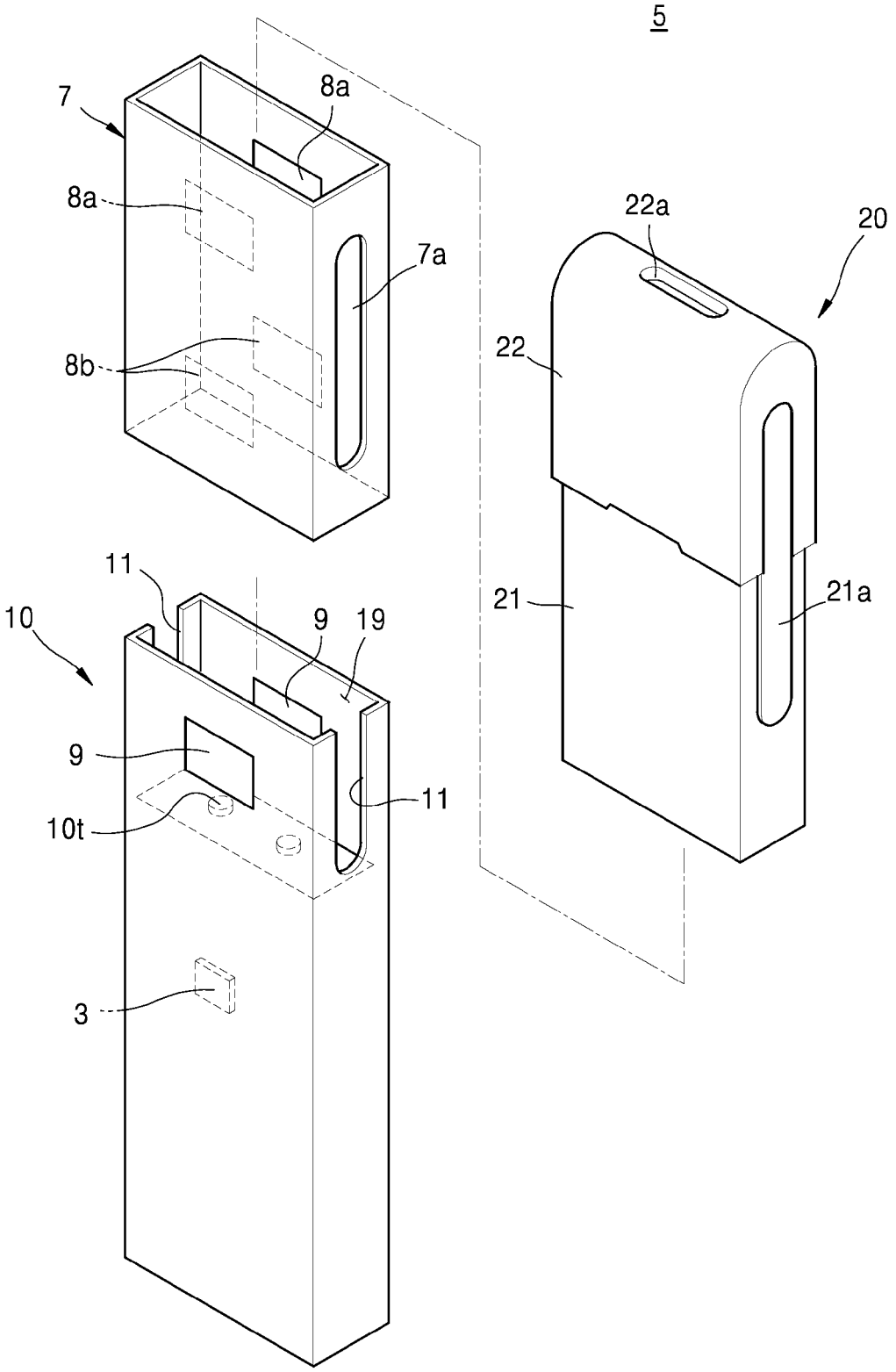

[Fig. 2]
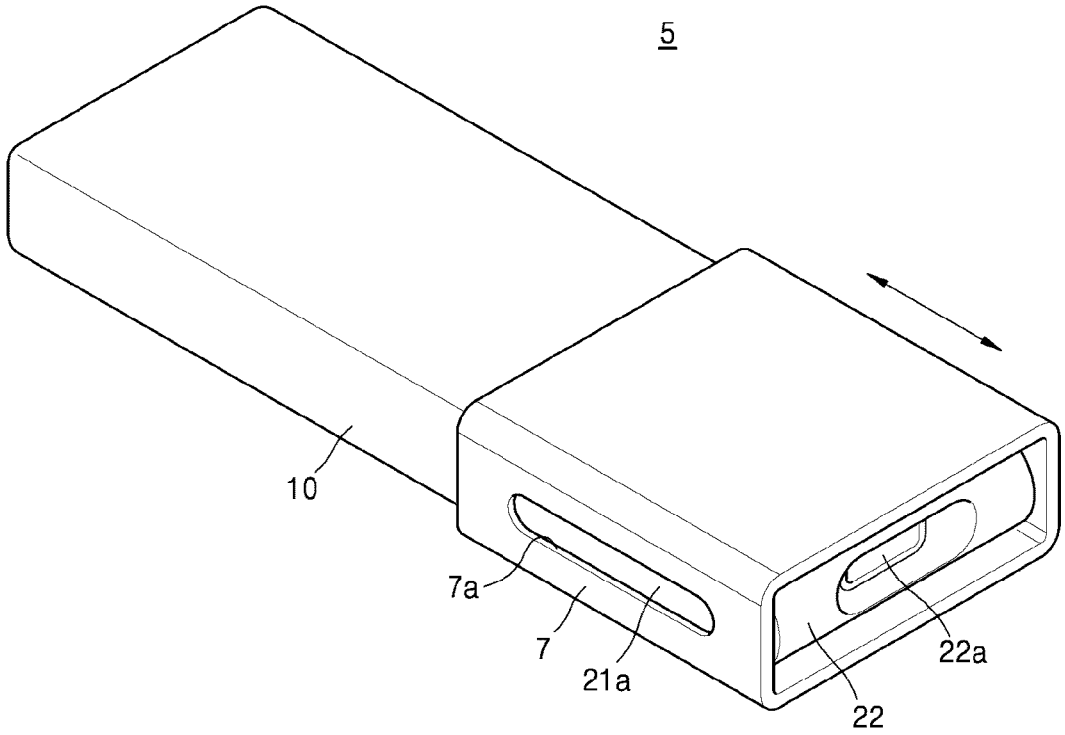
[Fig. 3]
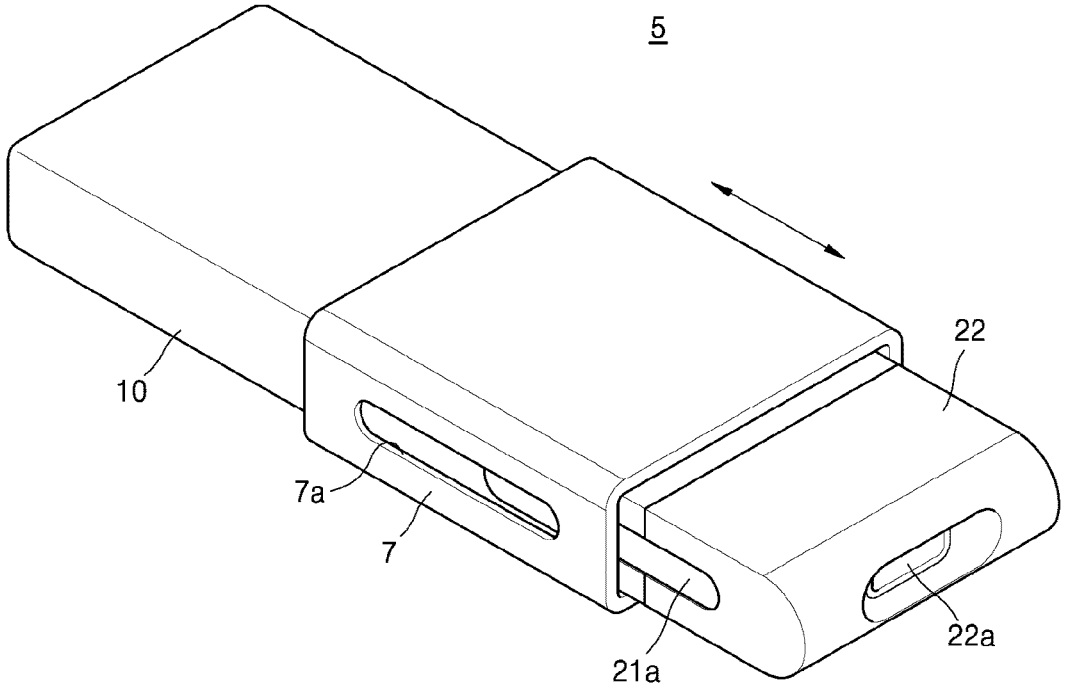

[Fig. 4]
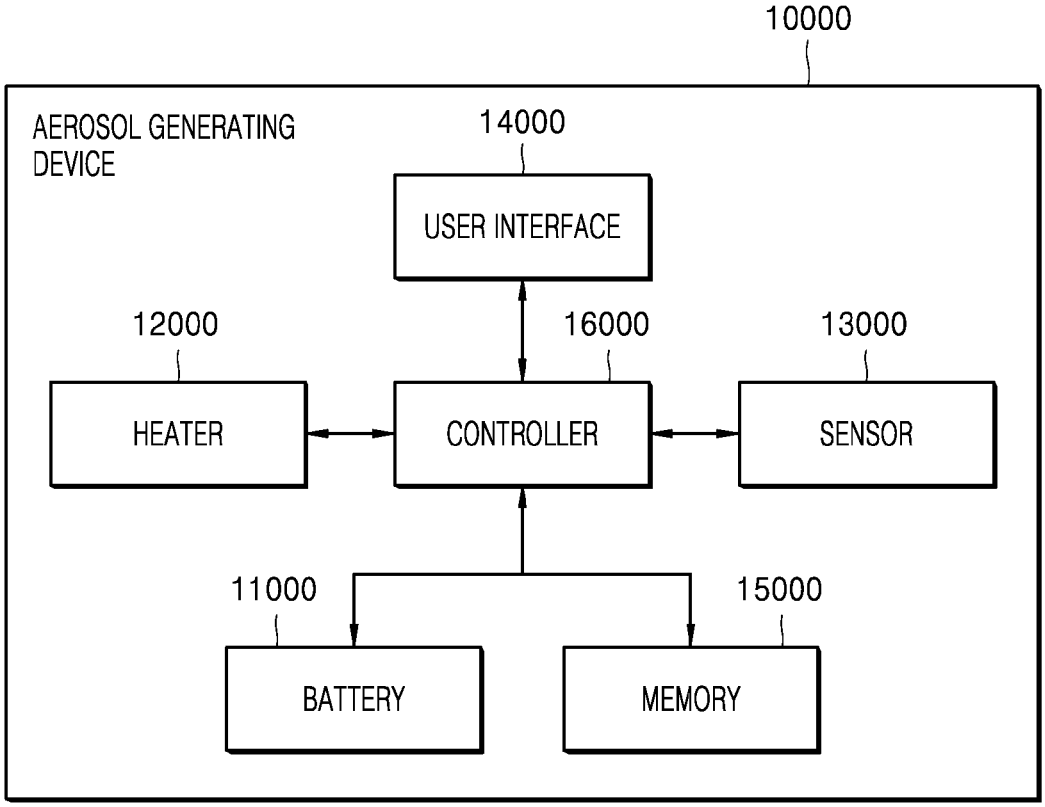

[Fig. 5]
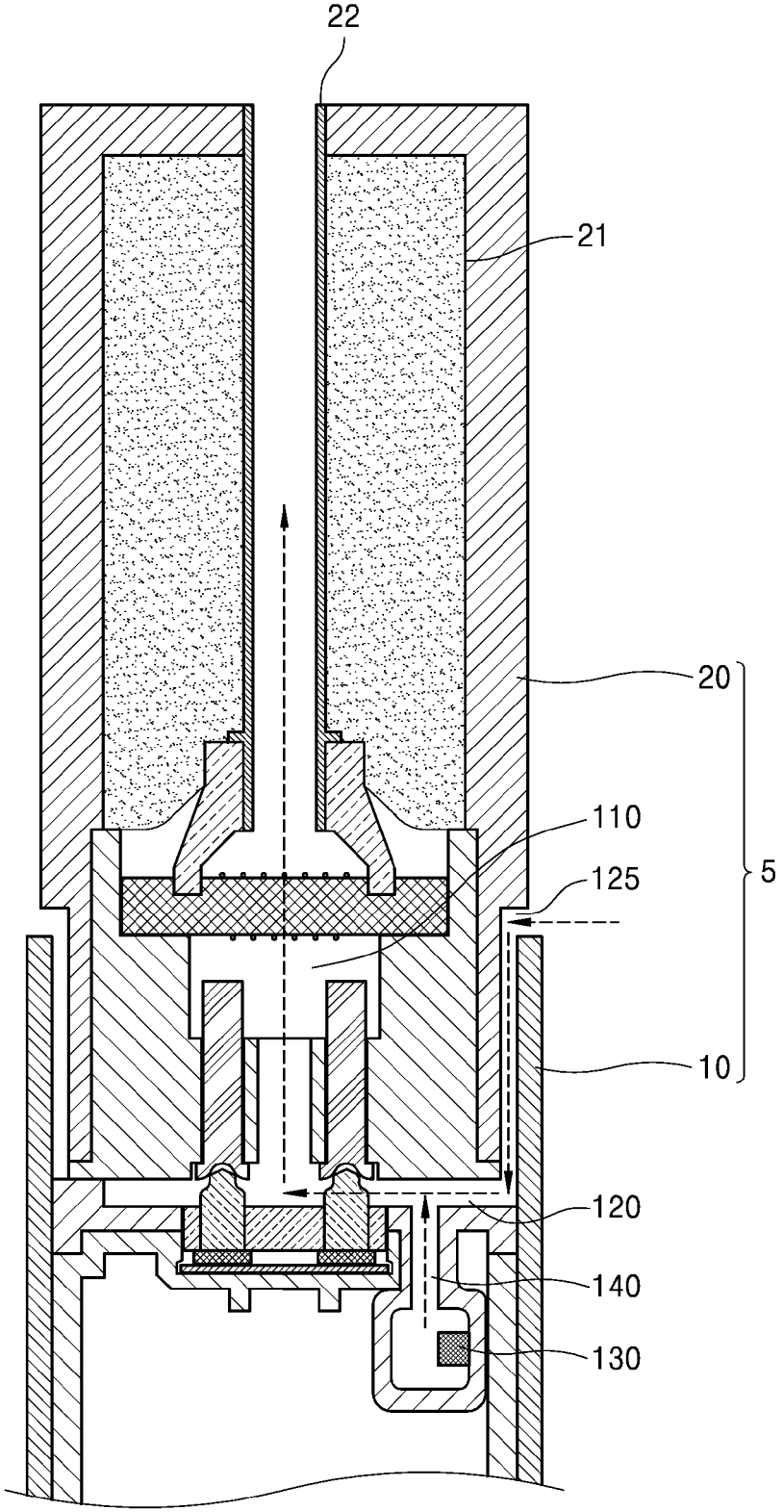

[Fig. 7A]
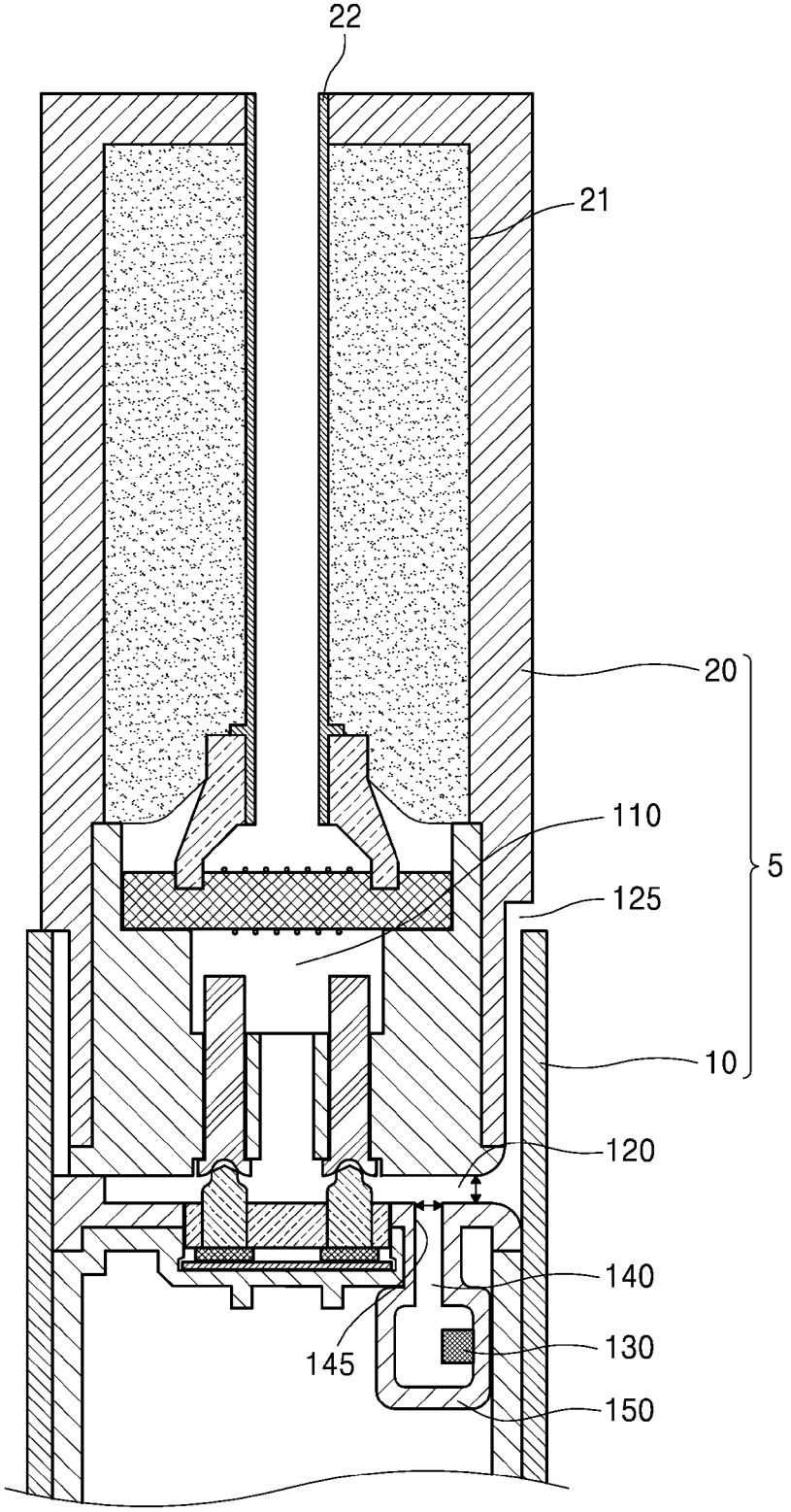

[Fig. 7B]
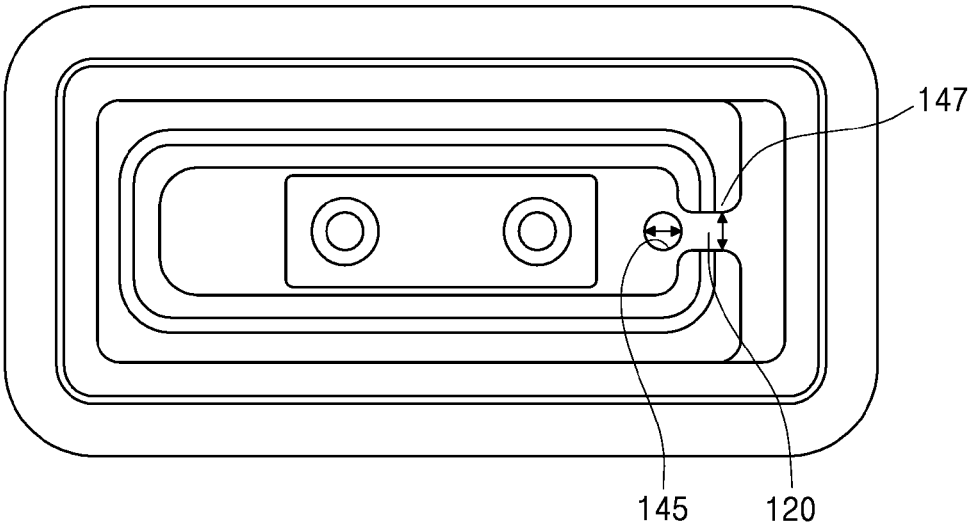

[Fig. 8A]
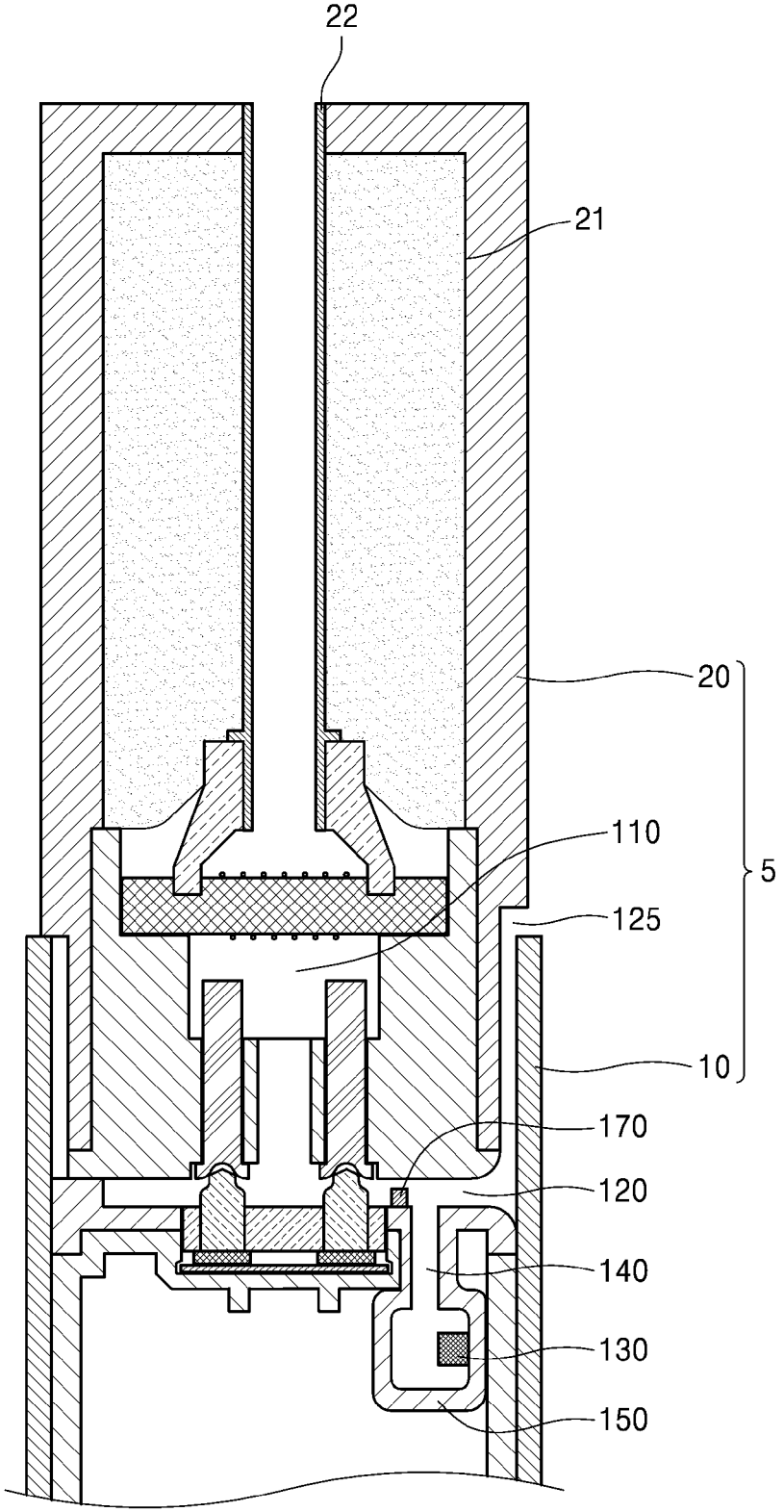

[Fig. 8B]
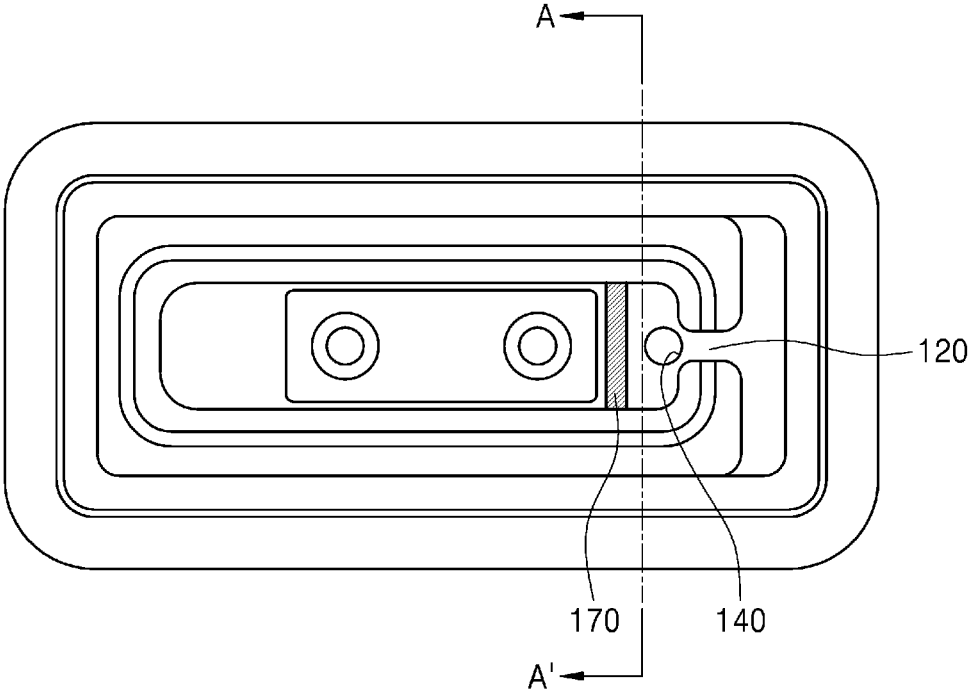
[Fig. 8C]
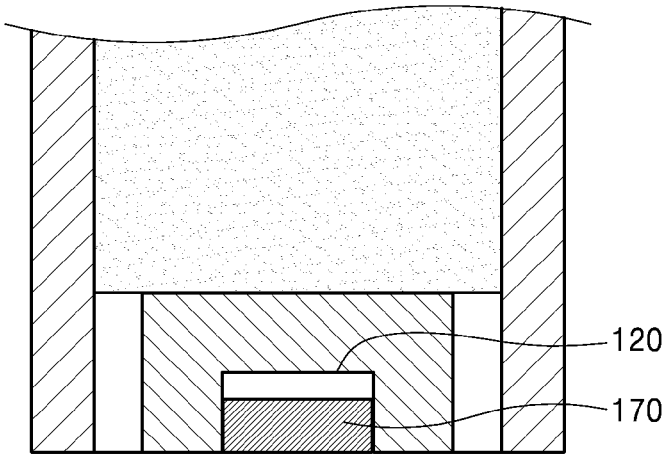

AEROSOL GENERATING DEVICE

TECHNICAL FIELD

Example embodiments of the present disclosure relate to an aerosol generating device, and more particularly, to an aerosol generating device that generates aerosol by heating an aerosol generating material.

BACKGROUND ART

Recently, there has been a growing demand for an alternative for traditional combustible cigarettes. In particular, a method of generating aerosol by heating an aerosol generating material contained in an aerosol generating article (e.g., a cigarette), rather than by combusting the aerosol generating material. Accordingly, studies on heating-type aerosol generating articles and heating-type aerosol generating devices have actively been conducted.

In general, a heating-type aerosol generating device accommodates an aerosol generating material therein, and the aerosol generating material may be heated together with air flowing into the aerosol generating device from outside through an air inlet, thereby generating aerosol.

Air may flow into the aerosol generating device from outside according to a user's puff (i.e., inhalation), and the aerosol generating device may change its operations in various ways in response to detecting the user's puff.

To this end, the aerosol generating device may include a puff detection sensor to detect the user's puff. The sensor may be arranged in a main air channel that permits fluid communication. between the air inlet and an atomizer in the aerosol generating device. However, when the sensor is arranged in the main air channel, air flow may be impeded, and sensitivity and operational stability of the sensor are reduced since the sensor may come into direct contact with external contaminants or the generated aerosol.

In addition, leakage from a cartridge accommodating a liquid composition may flow into the sensor through the main air channel. In this case, the sensor may malfunction and may be damaged in the worst cases. Since malfunction or breakage of the sensor may cause discomfort to the user when using the aerosol generating device, studies have actively been conducted in the prior art to prevent leakaaes from flowing to the sensor.

DISCLOSURE OF INVENTION

Solution to Problem

Example embodiments of the present disclosure provide an aerosol generating device including a sensor that detects a user's puff by measuring a change in flow rate or pressure of a separate air channel that extends from a main air channel to a sensor accommodation portion accommodating a sensor. Thus, sensitivity of the sensor may be improved, and at the same time, the sensor may be protected from external contaminants.

Example embodiments of the present disclosure provide an aerosol generating device that has improved operational stability by including a second air channel extending from a first air channel, which guides external air to the outside through the atomizer, to an accommodation space accommodating a sensor.

In addition, example embodiments of the present disclosure provide an aerosol generating device further including a leakage blocking portion preventing leakages from an atomizer of the aerosol generating device from flowing into the first air channel.

Example embodiments of the present disclosure are not limited thereto. It is to be appreciated that other embodiments will be apparent to those skilled in the art from a consideration of the specification or practice of the present disclosure described herein.

The aerosol generating device includes: a cartridge comprising: an atomizer heating an aerosol generating material to generate aerosol; a mouthpiece through which the generated aerosol is released to outside; a main body accommodating the cartridge; and a sensor configured to detect release of the aerosol to the outside; wherein a first air channel is formed between the cartridge and the main body and guides external air introduced through an air inlet to the mouthpiece through the atomizer, and wherein a second air channel is formed in the main body such that the first air channel and the second air channel are in fluid communication, and wherein the sensor detects the release of the aerosol to the outside based on a change in air flow rate or air pressure of the second air channel.

Advantageous Effects of Invention

An aerosol generating device according to embodiments of the present disclosure includes a second air channel extending from a first air channel and a sensor for detecting a user's puff by measuring a change in flow rate or pressure of the second air channel. A width of the first air channel may be changed to be identical to a width of the second air channel. As a result, sensitivity of the sensor may be improved, and at the same time the sensor may be protected from external contaminants.

An aerosol generating device according to embodiments of the present disclosure may include a sensor accommodation portion for accommodating the sensor. As the sensor is accommodated in the sensor accommodation portion, which is a separate space in the aerosol generating device, the sensor may be spaced apart, by a predetermined distance, from the first air channel into which air flows from outside. Thus, the sensor may be prevented from coming into contact with contaminants that may be introduced with air from outside.

In addition, according to example embodiments of the present disclosure, the aerosol generating device may include a leakage blocking portion, which may prevent leakages generated in the aerosol generating device from flowing to the sensor to prevent damage or breakage of the sensor due to the leakages.

BRIEF DESCRIPTION OF DRAWINGS

FIG. 1 is an exploded perspective view schematically illustrating a coupling relationship between a replaceable cartridge containing an aerosol generating material and an aerosol generating device including the same according to an embodiment of the present disclosure.

FIG. 2 is a perspective view illustrating an example operating state of the aerosol generating device according to the embodiment shown in FIG. 1.

FIG. 3 is a perspective view illustrating another example operating state of the aerosol generating device according to the embodiment shown in FIG. 1

FIG. 4 is a block diagram of an aerosol generating device according to an embodiment of the present disclosure.

FIG. 5 is a longitudinal cross-sectional view of an aerosol generating device according to an embodiment of the present disclosure.

FIG. 7A is a longitudinal cross-sectional view of an aerosol generating device according to another embodiment of the present disclosure.

FIG. 7B is a lateral cross-sectional view of the aerosol generating device shown in FIG. 7A.

FIG. 8A is a longitudinal cross-sectional view of an aerosol generating device according to yet another embodiment.

FIG. 8B is a lateral cross-sectional view of an aerosol generating device shown in FIG. 8A.

FIG. 8C is a partial cross-sectional view of an aerosol generating device shown in FIG. 8A from another point of view.

BEST MODE FOR CARRYING OUT THE INVENTION

Figure 6:
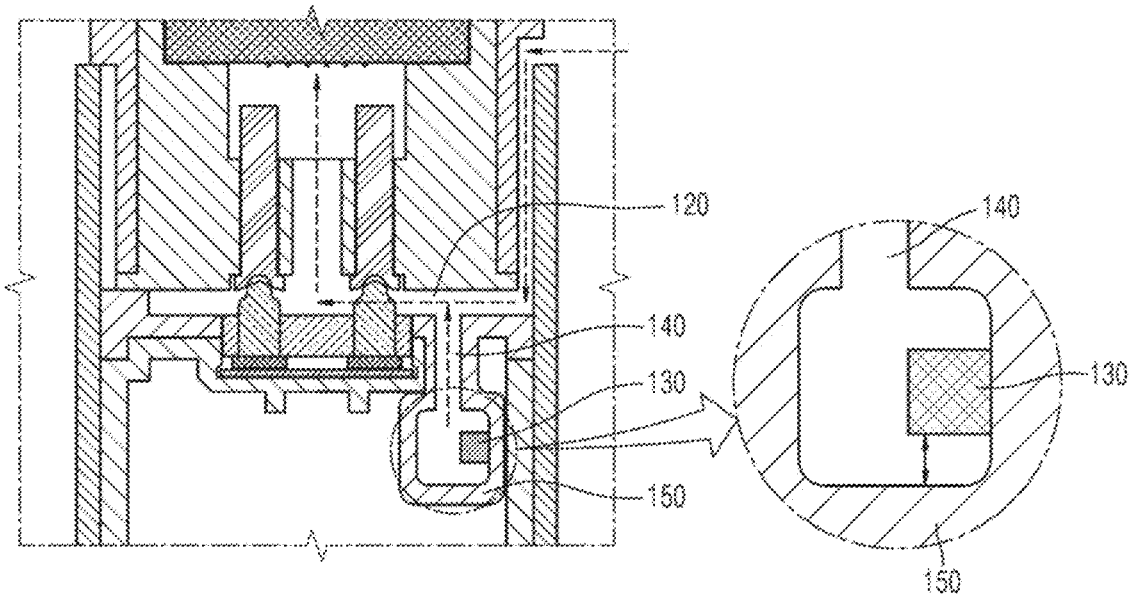
FIG. 6 is an enlarged partial view of a longitudinal cross-sectional view of the aerosol generating device shown in FIG. 5.

Example embodiments of the present disclosure provide an aerosol generating device including: a cartridge comprising: an atomizer heating an aerosol generating material to generate aerosol; a mouthpiece through which the generated aerosol is released to outside; a main body accommodating the cartridge; and a sensor configured to detect release of the aerosol to the outside; wherein a first air channel is formed between the cartridge and the main body and guides external air introduced through an air inlet to the mouthpiece through the atomizer, and wherein a second air channel is formed in the main body such that the first air channel and the second air channel are in fluid communication, and wherein the sensor detects the release of the aerosol to the outside based on a change in air flow rate or air pressure of the second air channel.

The main body may include a sensor accommodation portion accommodating the sensor, and the sensor accommodation portion may be in fluid communication with the first air channel through the second air channel.

The sensor may be spaced apart from a bottom surface of the sensor accommodation portion.

The sensor may be arranged on a side wall of the sensor accommodation portion.

A volume of the sensor accommodation portion may be two to four times a volume of the sensor.

A second air channel inlet may be formed in a portion of the second air channel at a position where the first air channel and the second air channel meet, and the second air channel inlet may be arranged between the air inlet and the atomizer.

A width of the first air channel at a periphery of the air inlet may be greater than a width of the first air channel at a periphery of the second air channel inlet.

The width of the first air channel at the periphery of the air inlet may correspond to a width of the second air channel.

The main body may include a wall portion formed on a surface of the main body such that the width of the first air channel is reduced to the width of the second air channel at the periphery of the second air channel inlet.

The leakage blocking portion may be formed in a portion of the first air channel between the atomizer and the second air channel.

The leakage blocking portion may protrude by a predetermined distance from a bottom surface of the portion of the first air channel such that the first air channel is partially shielded.

A cross-sectional area of the portion of the first air channel in which the leakage blocking portion is formed is 1.2 to 1.8 times a cross-sectional area of the leakage blocking portion.

MODE FOR THE INVENTION

With respect to the terms used to describe the various embodiments, general terms which are currently and widely used are selected in consideration of functions of structural elements in the various embodiments of the present disclosure. However, meanings of the terms can be changed according to intention, a judicial precedence, the appearance of new technology, and the like. In addition, in certain cases, a term which is not commonly used can be selected. In such a case, the meaning of the term will be described in detail at the corresponding portion in the description of the present disclosure. Therefore, the terms used in the various embodiments of the present disclosure should be defined based on the meanings of the terms and the descriptions provided herein.

In addition, unless explicitly described to the contrary, the word "comprise" and variations such as "comprises" or "comprising" will be understood to imply the inclusion of stated elements but not the exclusion of any other elements. In addition, the terms "-er", "-or", and "module" described in the specification mean units for processing at least one function and/or operation and can be implemented by hardware components or software components and combinations thereof.

As used herein, expressions such as "at least one of," when preceding a list of elements, modify the entire list of elements and do not modify the individual elements of the list. For example, the expression, "at least one of a, b, and c," should be understood as including only a, only b, only c, both a and b, both a and c, both b and c, or all of a, b, and c.

It will be understood that when an element or layer is referred to as being "over," "above," "on," "connected to" or "coupled to" another element or layer, it can be directly over, above, on, connected or coupled to the other element or layer or intervening elements or layers may be present. In contrast, when an element is referred to as being "directly over," "directly above," "directly on," "directly connected to" or "directly coupled to" another element or layer, there are no intervening elements or layers present. Like numerals refer to like elements throughout.

Hereinafter, the present disclosure will now be described more fully with reference to the accompanying drawings, in which example embodiments of the present disclosure. are shown such that one of ordinary skill in the art May easily work the present disclosure. The disclosure can, however, be embodied in many different forms and should not be construed as being limited to the embodiments set forth herein.

The terms used in the present disclosure are for describing the various embodiments and not intended to limit the embodiments. In the present disclosure, a singular form includes a plural forrn unless otherwise specified in phrases.

FIG. 1 is an exploded perspective view schematically illustrating a coupling relationship between a replaceable cartridge containing an aerosol generating material and an aerosol generating device including the same, according to an embodiment.

An aerosol generating device 5 according to the embodiment illustrated in FIG. 1 includes the cartridge 20 containing the aerosol generating material and a main body 10 supporting the cartridge 20.

The cartridge 20 containing the aerosol generating material may be coupled to the main body. A portion of the cartridge 20 may be inserted into an accommodation space 19 of the main body 10 so that the cartridge 20 may be mounted on the min body 10.

The cartridge and the main body of the aerosol generating device are illustrated as detachable from each other in FIG. 1. However, embodiments of the present disclosure are not limited thereto, and the cartridge and the main body may be not detachable from each other.

At least a portion of the liquid storage 21 of the cartridge 20 may include a transparent portion so that the aerosol generating material accommodated in the cartridge 20 may be visually identified from the outside. The liquid storage 21 includes a protruding window 21*a* protruding from the liquid storage 21, so that the liquid storage 21 may be inserted into a groove 11 of the main body 10 when coupled to the main body 10. A mouthpiece 22 and/or the liquid storage 21 may be entirely formed of transparent plastic or glass. Alternatively, only the protruding window 21*a* may be formed of a transparent material.

The main body 10 includes a connection terminal 10*t* arranged inside the accommodation space 19. When the liquid storage 21 of the cartridge 20 is inserted into the accommodation space 19 of the main body 10, the main body 10 may provide power to the cartridge 20 or supply a signal related to an operation of the cartridge 20 to the cartridge 20, through the connection terminal 10*t*.

The slider 7 is coupled to the main body 10 in such a way that the slider 7 may move on the main body 10. The slider 7 covers or exposes at least a portion of the mouthpiece 22 of the cartridge 20 coupled to the main body 10 by moving with respect to the main body 10. The slider 7 includes an elongated hole 7*a* exposing at least a portion of the protruding window 21*a* of the cartridge 20 to the outside.

As shown FIG. 1, the slider 7 may have a shape of a hollow container with both ends opened, but the structure of the slider 7 is not limited thereto. For example, the slider 7 may have a bent plate structure having a clip-shaped cross-section, which is movable with respect to the main body 10 while being coupled to an edge of the main body 10. In another example, the slider 7 may have a curved send-cylindrical shape with a curved arc-shaped cross section.

The slider 7 may include a magnetic body for maintaining the position of the slider 7 with respect to the main body 10 and the cartridge 20. The magnetic body may include a permanent magnet or a material such as iron, nickel, cobalt, or an alloy thereof.

The magnetic body may include two first magnetic bodies 8*a* facing each other, and two second magnetic bodies 8*b* facing each other. The first magnetic bodies 8*a* may be spaced apart from the second magnetic bodies 8*b* in a longitudinal direction of the main body 10 the direction in which the main body 10 extends), which is a moving direction of the slider 7.

The main body 10 includes a fixed magnetic body 9 arranged on a path along which the first magnetic bodies 8*a* and the second magnetic bodies 8*b* of the slider 7 move as the slider 7 moves with respect to the main body 10. Two fixed magnetic bodies 9 of the main body 10 may be mounted to face each other with the accommodation space 19 therebetween.

The slider 7, the slider 7 may be stably maintained in a position where an end of the mouthpiece 22 is covered or exposed by a magnetic force acting between the fixed magnetic body 9 and the first magnetic body 8*a* or between the fixed magnetic body 9 and the second magnetic body 8*b*.

The main body 10 includes a position change detecting sensor 3 arranged on the path along which the first magnetic body 8*a* and the second magnetic body 8*b* of the slider 7 move as the slider 7 moves with respect to the main body 10. The position change detecting sensor 3 may include, for example, a Hall integrated circuit (IC) that uses the Hall effect to detect a change in a magnetic field, and may generate a signal based on the detected change.

In the aerosol generating device 5 according to the above-described embodiments, horizontal cross sections of the main body 10, the cartridge 20, and the slider 7 have approximately rectangular shapes (i.e., when viewed in the longitudinal direction), but in the embodiments, the shape of the aerosol generating device 5 is not limited. The aerosol generating device 5 may have, for example, a cross-sectional shape of a circle, an ellipse, a square, or various polygonal shapes. In addition, the aerosol generating device 5 is not necessarily limited to a structure that extends linearly, and may be curved in a streamlined shape or bent at a preset angle in a specific area to be easily held by the user.

FIG. 2 is a perspective view of an example operating state of the aerosol generating device according to the embodiment illustrated in FIG. 1.

In FIG. 2, the slider 7 is moved to a position where the end of the mouthpiece 22 of the cartridge coupled to the main body 10 is covered. In this state, the mouthpiece 22 may be safely protected from external impurities and kept clean.

The user may check the remaining amount of aerosol generating material contained in the cartridge by visually checking the protruding window 21*a* of the cartridge through the elongated hole 7*a* of the slider 7. The user may move the slider 7 in the longitudinal direction of the main body 10 to use the aerosol generating device 5.

FIG. 3 is a perspective view of another example operating state of the aerosol generating device according to the embodiment illustrated in FIG. 1.

In FIG. 3, the operating state is shown in which the slider 7 is moved to a position where the end of the mouthpiece 22 of the cartridge coupled to the main body 10 is exposed to the outside. In this state, the user may insert the mouthpiece 22 into his or her mouth and inhale aerosol discharged through the discharge hole 22*a* of the mouthpiece 22.

As shown in FIG. 3, the protruding window 21*a* of the cartridge is still exposed to the outside through the elongated hole 7*a* of the slider 7 when the slider 7 is moved to the position where the end of the mouthpiece 22 is exposed to the outside. Thus, the user may visually check the remaining amount of aerosol generating material contained in the cartridge, regardless of the position of the slider 7.

FIG. 4 is a block diagram of the aerosol generating device according to an embodiment.

Referring to FIG. 4, the aerosol generating device 10000 may include a battery 11000, a heater 12000, a sensor 13000, a user interface 14000, a memory 15000, and a controller 16000. However, the internal structure of the aerosol generating device 10000 is not limited to the structures illustrated in FIG. 4. Also, it will be understood by one of ordinary skill in the art that some of the hardware components shown in FIG. 4 may be omitted or new components may be added according to the design of the aerosol generating device 5.

In an embodiment where the aerosol generating device 10000 includes a main body without a cartridge, the components of the aerosol generating device 10000 may be located in the main body. In another embodiment where the aerosol generating device 10000 includes a main body and a cartridge, the components of the aerosol generating device 10000 may be located in the main body and/or the cartridge.

Hereinafter, an operation of each of the components will be described without being limited to location of the components.

The battery 11000 supplies electric power to be used for the aerosol generating device 10000 to operate. For example, the battery 11000 may supply power such that the heater 12000 may be heated. In addition, the battery 11000 may supply power required for operation of other components of the aerosol generating device 10000, such as the sensor 13000, the user interface 14000, the memory 15000, the controller 16000, etc. The battery 11000 may be a rechargeable battery or a disposable battery. For example, the battery 11000 may be a lithium polymer (LiPoly) battery, but is not limited thereto.

The heater 12000 receives power from the battery 11000 under the control of the controller 16000. The heater 12000 may receive power from the battery 11000 and heat a cigarette inserted into the aerosol generating device 10000, or heat the cartridge mounted on the aerosol generating device 10000.

The heater 12000 may be located in the main body of the aerosol generating device 10000. Alternatively, the heater 12000 may be located in the cartridge. When the heater 12000 is located in the cartridge, the heater 12000 may receive power from the battery 11000 located in the main body andlor the cartridge.

The heater 12000 may be formed of any suitable electrically resistive material. For example, the suitable electrically resistive material may be a metal or a metal alloy including titanium, zirconium, tantalum, platinum, nickel, cobalt, chromium, hafnium, niobium, molybdenum, tungsten, tin, gallium, manganese, iron, copper, stainless steel, or nichrome, but is not limited thereto. In addition, the heater 12000 may be implemented by a metal wire, a metal plate on which an electrically conductive track is arranged, or a ceramic heating element, but is not limited thereto.

In an embodiment, the heater 12000 may be included in the cartridge. Ihe cartridge may include the heater 12000, the liquid delivery element, and the liquid storage. The aerosol generating material accommodated in the liquid storage may be absorbed by the liquid delivery element, and the heater 12000 may heat the aerosol generating material absorbed by the liquid delivery element, thereby generating aerosol. For example, the heater 12000 may include a material such as nickel chromium and may be wound around or arranged adjacent to the liquid delivery element.

Meanwhile, the heater 12000 may include an induction heater. The heater 13000 may include an electrically conductive coil for heating a cigarette or the cartridge by an induction heating method, and the cigarette or the cartridge may include a susceptor which may be heated by the induction heater.

Ihe aerosol generating device 10000 may include at least one sensor 13000. A result sensed by the at least one sensor 13000 is transmitted to the controller 16000, and the controller 16000 may control the aerosol generating device 10000 by controlling the operation of the heater, restricting smoking, determining whether a cigarette (or a cartridge) is inserted, displaying a notification, etc.

Ihe user interface 14000 may provide the user with information about the state of the aerosol generating device 10000. For example, the user interface 14000 may include various interfacing devices, such as a display or a lamp for outputting visual information, a motor for outputting haptic information, a speaker for outputting sound. information, input/output (I/O) interfacing devices (for example, a button or a touch screen) for receiving information input from the user or outputting information to the user, terminals for performing data communication or receiving charging power, and/or communication interfacing modules for performing wireless communication (for example, Wi-Fi, Wi-Fi direct, Bluetooth, near-field communication (NFC), etc.) with external devices.

The memory 15000 may store various data processed or to be processed by the controller 16000. The memory 15000 may include various types of memories, such as dynamic random access memory (DRAM), static random access memory (SRAM) read-only memory (ROM), electrically erasable programmable read-only memory (EEPROM), etc.

For example, the memory 15000 may store an operation time of the aerosol generating device 10000, the maximum number of puffs, the current number of puffs, at least one temperature profile, data on a user's smoking pattern, etc. The controller 16000 may control overall operations of the aerosol generating device 10000. The controller 16000 may include at least one processor. A processor can be implemented as an array of a plurality of logic gates or can be implemented as a combination of a general-puipose microprocessor and a memory in which a program executable in the microprocessor is stored. It will be understood by one of ordinary skill in the art that the processor can be implemented in other forms of hardware.

The controller 16000 analyzes a result of the sensing by at least one sensor 13000, and controls processes that are to be performed subsequently. For example, the controller 16000 may recognize the user's puff (i.e., the release of aerosol to the outside) based on the sensing result of the sensor 13000.

The controller 16000 may control power supplied to the heater 12000 so that the operation of the heater 12000 is started or terminated, based on the result of the sensing by the at least one sensor 13000. In addition, based on the result of the sensing by the at least one sensor 13000, the controller 16000 may control the amount of power supplied to the heater 12000 and the time at which the power is supplied, so that the heater 12000 is heated to a predetermined temperature or maintained at an appropriate. temperature.

In an embodiment, the controller 16000 may set a mode of the heater 12000 to a pre-heating mode to start the operation of the heater 1200 after receiving a user input to the aerosol generating device 10000. In addition, the controller 16000 may switch the mode of the heater 12000 from the pre-heating mode to an operation mode after detecting a user's puff by using the puff detecting sensor. In addition, the controller 16000 may stop supplying power to the heater 12000 when the number of puffs reaches a preset number after counting the number of puffs by using the puff detecting sensor.

The controller 16000 may control the user interface 14000 based on the result of the sensing by the at least one sensor 13000. For example, when the number of puffs counted by the puff detecting sensor reaches a preset number, the controller 16000 may notify the user by using the user interface 14000 (e.g., a lamp, a motor, a speaker, etc.) that the aerosol generating device 10000 will soon be terminated.

Although not illustrated in FIG. 4, the aerosol generating device 10000 may be combined with a separate cradle to form an aerosol generating system. For example, the cradle may be used to charge the battery 11000 of the aerosol generating device 10000. For example, the aerosol generating device 10000 may be supplied with power from a battery of the cradle to charge the battery 11000 of the aerosol generating device 10000 while being accommodated in an accommodation space of the cradle.

FIG. 5 is a longitudinal (i.e., vertical) cross-sectional view of the aerosol generating device 5 according to an embodiment.

According to an embodiment, the aerosol generating device 5 may include a cartridge 20, a main body 10, and a sensor 130.

The cartridge 20 may include an atomizer 110 heating an aerosol generating material stored in the liquid storage 21 to generate an aerosol, and a mouthpiece portion 22 through which the generated aerosol is released.

The main body 10 mays accommodate the cartridge 20. A first air channel 120 may allow external air may flow in through an air inlet 125 formed between the cartridge 20 and the main body 10. The first air channel 120 may permit fluid communication between the atomizer 110 and the mouthpiece portion 22.

The sensor 130 may detect air flowing from the air inlet 125 into the mouthpiece portion 22. A second air channel 140 may communicate with the first air channel 120. The sensor 130 may detect release of the aerosol through the mouthpiece portion 22 by measuring a change in air flow rate or air pressure in the second air channel 140.

The cartridge 20 may contain an aerosol generating material in at least one of, for example, a liquid state, a solid state, a gaseous state, or a gel state. The aerosol generating material may include a liquid composition. For example, the liquid composition may be a liquid including a tobacco-containing material having a volatile tobacco flavor component, or a liquid including a non-tobacco material.

For example, the liquid composition may include one component of water, solvents, ethanol, plant extracts, spices, flavorings, and vitamin mixtures, or a mixture of these components. The spices may include menthol, peppermint, spearmint oil, and various fruit-flavored ingredients, but are not limited thereto. The flavorings may include in-gredients capable of providing various flavors or tastes to a user. Vitamin mixtures may be a mixture of at least one of vitamin A, vitamin B, vitamin C, and vitamin E, but are not limited thereto. In addition, the liquid composition may include an aerosol forming agent such as glycerin and propylene glycol.

For example, the liquid composition may include any weight ratio of glycerin and propylene glycol solution to which nicotine salts are added. The liquid composition may include two or more types of nicotine salts. Nicotine salts may be formed by adding suitable acids, including organic or inorganic acids, to nicotine. Nicotine may be a naturally generated nicotine or synthetic nicotine and may have any suitable weight concentration relative to the total solution weight of the liquid composition.

Acid for the formation of the nicotine salts may be appropriately selected in consideration of the rate of nicotine absorption in the blood, the operating temperature of the aerosol generating device 5, the flavor or savor, the solubility, or the like. For example, the acid for the formation of nicotine salts may be a single acid selected from the group consisting of benzoic acid, lactic acid, salicylic acid, lauric acid, sorbic acid, levulinic acid, pyruvic acid, formic acid, acetic acid, propionic acid, butyric acid. valeric acid, caproic acid, caprylic acid, capric acid, citric acid, myristic acid, palmitic acid, stearic acid, oleic acid, linoleic acid, linolenic acid, phenylacetic acid, tartaric acid, succinic acid, fumaric acid, gluconic acid, saccharic acid, malonic acid, and malic acid, or may be a mixture of two or more acids selected from the above-described group, but is not limited thereto.

The cartridge 20 may be operated by an electrical signal or a wireless signal transmitted from the main body 10 to perform a function of generating aerosol by converting the phase of the aerosol generating material inside the cartridge 20 to a gaseous phase. The aerosol may refer to a gas in which vaporized particles generated from an aerosol generating material are mixed with air.

For example, in response to receiving the electrical signal from the main body 10, the cartridge 20 may convert the phase of the aerosol generating material by heating the aerosol generating material, using, for example, an ultrasonic vibration method or an induction heating method. In an embodiment, the cartridge 20 may include its own power source and generate aerosol based on an electric control signal or a wireless signal received from the main body 10.

The cartridge 20 may include a liquid storage 21 accommodating the aerosol generating material therein, and an atomizer 110 performing a function of converting the aerosol generating material of the liquid storage 21 to aerosol.

When the liquid storage 21 "accommodates the aerosol generating material" therein, it means that the liquid storage 21 functions as a container simply holding an aerosol generating material and that the liquid storage 21 includes therein an element impregnated with (i.e., containing) an aerosol generating material, such as a sponge, cotton, fabric, or porous ceramic structure.

The atomizer 110 may include, for example, a liquid delivery element (e.g., a wick) for absorbing the aerosol generating material and maintaining the same in an optimal state for conversion to aerosol, and a heater heating the liquid delivery element to generate aerosol.

The liquid delivery element may include at least one of, for example, a cotton fiber, a ceramic fiber, a glass fiber, and porous ceramic.

The heater may include a metallic material such as copper, nickel, tungsten, or the like to heat the aerosol generating material delivered to the liquid delivery element by generating heat using electrical resistance. The heater may be implemented by, for example, a metal wire, a metal plate, a ceramic heating element, or the like. Also, the heater may be implemented by a conductive filament using a material such as a nichrome wire, and may be wound around or arranged adjacent to the liquid delivery element.

In addition, the atomizer 110 may be implemented by a heating element in the form of a mesh or plate, which absorbs the aerosol generating material and maintains the same in an optimal state for conversion to aerosol, and generates aerosol by heating the aerosol generating material. In this case, a separate liquid delivery element may not be required.

In the aerosol generating device 5 according to an embodiment, the mouthpiece portion 22 may include a portion that directly contacts the user's mouth. The aerosol generated from the aerosol generating device 5 may be delivered to the user through the mouthpiece portion 22.

For example, the user may operate the aerosol generating device 5 to generate aerosol by heating the aerosol generating material and contact his or her mouth with the mouthpiece portion 22 to inhale the aerosol.

Therefore, the mouthpiece portion 22 of the aerosol generating device 5 may have user's saliva left thereon after the user's smoking. In that case, microorganisms may survive or grow in the mouthpiece portion 22. In order to suppress the survival or growth of those microorganisms, the mouthpiece 22 of the aerosol generating device 5 may be made of a material with an antibacterial function.

According to an embodiment, the main body 10 may accommodate the cartridge 20. As described above, the main body 10 may support the cartridge 20 on one side and supply power for the cartridge 20 to generate aerosol.

According to an embodiment, the aerosol generating device 5 may include the air inlet 125 formed between the cartridge 20 and the main body 10 so that external air flows in through the air inlet 125. The first air channel 120 may allow air to flow from the air inlet 125 to the mouthpiece portion 22 through the atomizer 110.

The cartridge 20 may generate aerosol by heating the aerosol generating material stored in the liquid storage 21. More specifically, the aerosol generating material may be heated together with air flowing into the aerosol generating device 5 from outside through the air inlet 125, and the aerosol may be generated as the heated aerosol generating material is mixed with the air from outside.

Air may flow into the aerosol generating device 5 from outside through the air inlet 125, and the air inlet 125 may be a gap between the cartridge 20 and a surface of the main body 10. The gap between the cartridge 20 and a surface of the main body 10 may be formed due to a cleft between the respective components. Though embodiments are not limited thereto, the air inlet 125 may be formed by a separate through hole positioned between the cartridge 20 and the main body 10.

The first air channel 120 may extend from the air inlet 125 to the atomizer 110 and further to the mouthpiece portion 22. As such, the first air channel 120 may be in fluid communication with the outside, the atomizer 110, and the mouthpiece portion 22. In other words, air introduced through the air inlet 125 may pass through the atomizer 110, and then be discharged to the outside through the mouthpiece portion 22.

The first air channel 120 may include a space extending between the cartridge 20 and the main body 10. For example, when the main body 10 accommodates the cartridge 20, a space may be formed between the main body 10 and the cartridge 20. In that case, the space between the cartridge 20 and the main body 10 may serve as the air inlet 125 described above.

In the aerosol generating device 5 according to an embodiment, an opening connected to the atomizer 110 may be formed at a lower end of the cartridge 20. The first air channel 120 may extend to the atomizer 110 and the mouthpiece portion 22 of the cartridge 20 through the opening at a lower end of the cartridge 20.

The air flowing into the air inlet 125 of the first air channel 120 may pass through the space extending between the cartridge 20 and the main body 10, and pass through the opening at a lower end of the cartridge 20 to flow into the atomizer 110. The air flowing into the atomizer 110 may be inhaled together with the aerosol by the user through the mouthpiece portion 22.

According to an embodiment, the aerosol generating device 5 may include the sensor 130 detecting air flowing from the air inlet 125 to the mouthpiece portion 22. For example, the sensor 130 may include a puff detection sensor that detects the user's puff.

In the aerosol generating device 5 according to an embodiment, a second air channel 140 may be formed, which may extend from a portion of the first air channel 120.

The portion of the first air channel 120 from which the second air channel 140 extends may correspond to a space formed between the main body 10 and the cartridge 20 when the main body 10 accommodates the cartridge 20.

The second air channel 140 may be in fluid communication with the outside of the aerosol generating device 5 through the first air channel 120.

In the aerosol generating device 5 according to an embodiment, the sensor 130 may detect release of the aerosol through the mouthpiece portion 22 by measuring a change in air flow rate or air pressure in the second air channel 140.

When the user inhales, the aerosol generated in the aerosol generating device 5 flows out of the aerosol generating device 5 through the first air channel 120. At that time, air may also flow into the atomizer 110 and the mouthpiece portion 22 of the cartridge 20 from the outside of the aerosol generating device 5 through the first air channel 120.

As the aerosol and the air from outside flow out of the aerosol generating device 5 through the first air channel 120, air flow rate or air pressure in the first air channel 120 may be changed. Accordingly, the air flow rate or air pressure of the second air channel 140 in fluid communication with the first air channel 120 may be also changed.

In the aerosol generating device 5 according to an embodiment, the sensor 130 may detect release of the aerosol through the mouthpiece portion 22 by measuring the air flow rate or air pressure of the second air channel 140 as described above.

However, the air flow rate or air pressure in the second air channel 140 may be changed due to a cause other than the release of the aerosol (for example, a change in the external environment or a movement of the aerosol generating device 5).

To address this issue, the sensor 130 may include a mechanism for distinguishing between a change in the air flow rate or air pressure in the second air channel 140 due to the user's puff and a change in the air flow rate or air pressure in the second air channel 140 due to other causes. For example, the mechanism may refer to pre-stored values representing a change in air flow rate or pressure in the second air channel 140 which is caused due to the user's puff, to determine whether the detected changes is caused by the user's puff.

The aerosol generating device 5 according to an embodiment may include a sensor accommodation portion 150 which provides a space for accommodating the sensor 130. The sensor accommodation portion 150 may be in fluid communication with the first air channel 120 through the second air channel 140, and may be formed at one end portion of the main body 10.

The sensor accommodation portion 150 may be arranged close to the first air channel 120. For example, the sensor accommodation portion 150 may be arranged in an end portion of the main body 10 near the cartridge 20.

FIG. 6 is an enlarged partial view of a longitudinal cross-sectional view of the aerosol generating device 5 shown in FIG. 5.

Referring to FIG. 6, the sensor 130 may be positioned apart from a bottom surface of the sensor accommodation portion 150. In other words, the sensor 130 may be accommodated in the sensor accommodation portion 150 without contacting a bottom surface of the sensor accommodation portion 150. At that time, the sensor 130 may be arranged to be in contact with one side surface of the sensor accommodation portion 150.

During use of the aerosol generating device 5, a leakage may flow into the sensor accommodation portion 150. The leakage may be generated when the aerosol generating material heated in the atomizer 110 is condensed again, in this case, as the sensor 130 is spaced apart from a bottom surface of the sensor accommodation portion 150, the leakage flowing into the sensor accommodation portion 150 may be prevented from coming into direct contact with the sensor 130.

More specifically, since the sensor 130 is spaced apart from a bottom surface of the sensor accommodation portion 150, an immersion prevention space may be formed between a bottom surface of the sensor accommodation portion 150 and the sensor 130. The immersion prevention space may keep the leakage flowing into the sensor accommodation portion 150 from contacting the sensor 130.

The leakage staying in the immersion prevention space may be vaporized and removed from the sensor accommodation portion 150 after a predetermined period of time. Since the sensor 130 and the leakage are prevented from coming into direct contact with each other by the immersion prevention space, malfunction or breakage of the sensor 130 may be prevented.

The sensor accommodation portion 150 may include a bent portion for protecting the sensor 130 from the leakage dropping from above. As shown in FIG. 6, the bent portion may be positioned above at least a portion of the sensor 130. Alternatively, the bent portion may contact the top surface of the sensor 130.

A volume of the sensor accommodation portion 150 may be two times to four times a volume of the sensor 130. As such, the immersion prevention space between a bottom surface of the sensor accommodation portion 150 and the sensor 130 may be sufficiently large to keep the leakage from touching the sensor 130.

FIG. 7A is a longitudinal cross-sectional view of an aerosol izenerating device 5 according to another embodiment, and FIG. 7B is a lateral cross-sectional view of the aerosol generating device shown in FIG. 7A.

Referring to FIGS. 7A and 7B, similar to the embodiment of FIG. 6, the second air channel inlet 145 is in fluid communication with the first air channel 120. Also, the second air channel inlet 145 may be formed in a portion of the second air channel 140 where the first air channel 120 and the second air channel 140 meet. In other words, the second air channel 140 communicates with the first air channel 120 through the second air channel inlet 145. Thus, descriptions about the same configuration and effects of the respective components will be omitted.

In the aerosol generating device 5 according to an embodiment, the width (e.g., a diameter or a cross-section area) of the first air channel 120 near the second air channel inlet 145 may correspond to the width (i.e., a diameter or a cross-section area) of the second air channel 140.

As can be seen in FIG. 7A, according to an embodiment, the width of the first air channel 120 at the periphery of the air inlet 125 and the width of the first air channel 120 at the periphery of the second air channel inlet 145 may differ from each other. For example, the width of the first air channel 120 at the periphery of the air inlet 125 may be greater than the width of the first air channel 120 at the periphery of the second air channel inlet 145.

The width of the first air channel 120 at the periphery of the second air channel inlet 145 may be identical to the width of the second air channel 140. To this end, a wall portion 147 may be formed on one surface of the main body 10 to make the width of the first air channel 120 at the periphery of the second air channel inlet 145 identical to the width of the second air channel 140.

When the cartridge 20 is accommodated in the min body 10, a surface of the main body 10 on which the wall portion 147 is formed may face the cartridge 20, and the wall portion 147 may protrude by a predetermined distance toward the cartridge 20.

A gap may be formed in a portion of the wall portion 147, and the width of the first air channel 120 at the periphery of the second air channel inlet 145 may be changed depending on the width of the gap. For example, if the width of the gap is reduced, the width of the first air channel 120 is also reduced.

In the aerosol generating device 5 according to an embodiment, a gap may be formed to have a width corresponding to the width of the second air channel 140, and thus the width of the first air channel 120 at the periphery of the second air channel inlet 145 the second air channel inlet 145 may correspond to the width of the second air channel 140.

As the width of the first air channel 120 at the periphery of the second air channel inlet 145 corresponds to the width of the second air channel 140, air flow rate or air pressure may be similar between the first air channel 120 at the periphery of the second air channel inlet 145 and the second air channel inlet 145. Thus, the sensor 130 may detect a change in air flow rate or air pressure in the first air channel 120 through the second air channel 140. As a result, the sensor 130 may precisely detect the user's puff (i.e., release of the aerosol to the outside through the mouthpiece 22) without being damaged by the leakage from the cartridge.

FIG. 8A is a longitudinal cross-sectional view of the aerosol generating device 5 according to yet another embodiment. FIG. 8B is a lateral cross-sectional view of the aerosol generating device 5 shown in FIG. 8A. FIG. 8C is a partial cross-sectional view of the aerosol generating device 5 shown in 8B when cut along the line A-A'.

The aerosol generating device 5 shown in FIGS. 8A-8C may include the same components of the aerosol generating device 5 according to other embodiment described above. Since the configuration and effects of the respective components are the same as described above, the redundant detailed descriptions will be omitted.

Referring to FIGS. 8A-8C, the aerosol generating device 5 may include a leakage blocking portion 170 for preventing a leakage from the atomizer 110 from flowing into the second air channel 140 through the first air channel 120.

The leakage blocking portion 170 may be formed between the atomizer 110 and the second air channel 140. More specifically, the leakage blocking portion 170 may be formed in a portion of the first air channel 120 between the atomizer 110 and the second air channel 140 when the cartridge 20 is accommodated in the main body 10.

The leakage blocking portion 170 may protrude by a predetermined distance from a bottom surface of a portion of the first air channel 120 in a direction in which the first air channel 120 is shielded. The leakage blocking portion 170 may prevent the leakage from the atomizer 110 from flowing through the first air channel 120 by shielding a portion of the first air channel 120.

Referring to FIG. 8C, a ratio of a cross-sectional surface area of the leakage blocking portion 170 and a cross-sectional surface area of the portion of the first air channel 120 in which the leakage blocking portion 170 is formed may be roughly estimated.

In the aerosol generating device 5 according to an embodiment, the cross-sectional area of the portion of the first air channel 120 in which the leakage blocking portion 170 is formed may be 1.2 times to 1.8 times the cross-sectional area of the leakage blocking portion 170. It is desirable that the cross-sectional area of the portion of the first air channel 120 in which the leakage blocking portion 170 is formed to be 1.5 times the cross-sectional area of the leakage blocking portion 170.

Since the cross-sectional area of the portion of the first air channel 120 in which the leakage blocking portion 170 is formed is 1.2 times to 1.8 times the cross-sectional surface area of the leakage blocking portion 170, the portion of the first air channel 120 may not be hermetically sealed by the leakage blocking portion 170 to allow air from outside to flow. Thus, the leakaae blocking portion 170 may allow air from outside to flow and at the same time prevent the leakage from the atomizer 110 from flowing into the second air channel 140 through the first air channel 120.

As the leakage from the atomizer 110 is prevented from flowing into the second air channel 140 through the first air channel 120 by the leakage blocking portion 170, contact between the sensor 130 measuring a change in air flow rate and air pressure of the second air channel 140 and the leakage may be prevented. Thus, damage or breakage of the sensor 130 due to the leakage may be prevented.

At least one of the components, elements, modules or units (collectively "components" in this paragraph) represented by a block in the drawings such as the controller 16000, the user interface 14000, and the sensor 13000 in FIG. 4, may be embodied as various numbers of hardware, software and/or firmware structures that execute respective functions described above, according to an example embodiment. For example, at least one of these components may use a direct circuit structure, such as a memory, a processor, a logic circuit, a look-up table, etc. that may execute the respective functions through controls of one or more microprocessors or other control apparatuses. Also, at least one of these components may be specifically embodied by a module, a program, or a part of code, which contains one or more executable instructions for performing specified logic functions, and executed by one or more microprocessors or other control apparatuses. Further, at least one of these components may include or may be implemented by a processor such as a central processing unit (CPU) that performs the respective functions, a microprocessor, or the like. Two or more of these components may be combined into one single component which performs all operations or functions of the combined two or more components. Also, at least part of functions of at least one of these components may be performed by another of these components. Further, although a bus is not illustrated in the above block diagrams, communication between the components may be performed through the bus. Functional aspects of the above example embodiments may be implemented in algorithms that execute on one or more processors. Furthermore, the components represented by a block or processing steps may employ any number of related art techniques for electronics configuration, signal processing and/or control, data processing and the like.

Those of ordinary skill in the art pertaining to the present embodiments can understand that various changes in form and details can be made therein without departing from the scope of the characteristics described above. The disclosed methods should be considered in a descriptive sense only and not for purposes of limitation. The scope of the present disclosure is defined by the appended claims rather than by the foregoing description, and all differences within the scope of equivalents thereof should be construed as being included in the present disclosure.

The invention claimed is:

1. An aerosol generating device comprising:

a cartridge comprising:

an atomizer configured to heat an aerosol generating material to generate aerosol;

a mouthpiece through which the generated aerosol is released to outside;

a main body accommodating the cartridge; and a sensor configured to detect release of the aerosol to the outside, wherein a first air channel is formed between the cartridge and the main body and guides external air introduced through an air inlet to the mouthpiece through the atomizer, and wherein a second air channel is formed in the main body such that the first air channel and the second air channel are in fluid communication, wherein the sensor detects the release of the aerosol to the outside based on a change in air flow rate or air pressure of the second air channel, wherein a leakage blocking portion is disposed in a portion of the first air channel between the atomizer and the second air channel for preventing a leakage from the atomizer from flowing into the second air channel, the portion of the first air channel being disposed closer to a second air channel inlet of the second air channel than the atomizer, wherein the leakage blocking portion is formed in a shape of a square pillar protruding from a bottom surface of the portion of the first air channel, and wherein an end of the leakage blocking portion is spaced apart from a top surface of the portion of the first air channel opposite to the bottom surface of the portion of the first air channel and configured to partially block the first air channel such that external air is allowed to flow into the first air channel and at the same time leakage from the atomizer flowing is prevented from flowing into the second air channel.

2. The aerosol generating device of claim 1, wherein the main body comprises a sensor accommodation portion for accommodating the sensor, wherein the sensor accommodation portion is in fluid communication with the first air channel through the second air channel, wherein the sensor accommodation portion comprises a bent portion that is positioned above the sensor and configured to protect the sensor from leakage dropping from the second air channel, and wherein a width of the first air channel at a periphery of the second air channel inlet corresponds to a width of the second air channel at the periphery of the second air channel inlet such that a change in air flow rate or air pressure of the first air channel corresponds to the change in air flow rate or air pressure of the second air channel detected by the sensor.

3. The aerosol generating device of claim 2, wherein the sensor is spaced apart from a bottom surface of the sensor accommodation portion, the bottom surface of the sensor accommodation portion is located opposite an upper surface of the sensor accommodation portion where the second air channel is formed.

4. The aerosol generating device of claim 2, wherein the sensor accommodation portion includes an upper surface where the second air channel is formed, a bottom surface located opposite the upper surface, and a side wall connecting the upper surface with the bottom surface, and wherein the sensor is arranged on the side wall of the sensor accommodation portion.

5. The aerosol generating device of claim 2, wherein a volume of the sensor accommodation portion is two to four times a volume of the sensor.

6. The aerosol generating device of claim 1, wherein the second air channel inlet is formed in a portion of the second air channel at a position where the first air channel and the second air channel meet, and the second air channel inlet is arranged between the air inlet and the atomizer.

7. The aerosol generating device of claim 6, wherein a width of the first air channel at a periphery of the air inlet is greater than the width of the first air channel at the periphery of the second air channel inlet.

8. The aerosol generating device of claim 7, wherein the main body comprises a wall portion formed on a surface of the main body, and the wall portion defines the width of the first air channel at the periphery of the air inlet.

* * * * *